US008196682B2

(12) United States Patent
Dick et al.

(10) Patent No.: US 8,196,682 B2
(45) Date of Patent: Jun. 12, 2012

(54) EARTH BORING BIT WITH WEAR RESISTANT BEARING AND SEAL

(75) Inventors: Aaron J. Dick, Houston, TX (US); Chih Lin, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 449 days.

(21) Appl. No.: 12/417,416

(22) Filed: Apr. 2, 2009

(65) Prior Publication Data

US 2009/0194339 A1 Aug. 6, 2009

Related U.S. Application Data

(63) Continuation-in-part of application No. 12/172,364, filed on Jul. 14, 2008.

(60) Provisional application No. 60/949,756, filed on Jul. 13, 2007, provisional application No. 61/041,621, filed on Apr. 2, 2008.

(51) Int. Cl.
*E21B 10/22* (2006.01)

(52) U.S. Cl. ..... 175/371; 175/359

(58) Field of Classification Search ..... 175/359, 175/371, 374

See application file for complete search history.

(56) References Cited

U.S. PATENT DOCUMENTS

| | | | | |
|---|---|---|---|---|
| 2,904,374 | A * | 9/1959 | Boice | 384/95 |
| 3,936,295 | A | 2/1976 | Cromwell et al. | |
| 5,494,123 | A | 2/1996 | Nguyen | |
| 6,450,271 | B1 | 9/2002 | Tibbitts et al. | |
| 6,469,278 | B1 | 10/2002 | Boyce | |
| 6,800,383 | B1 | 10/2004 | Lakhotkin et al. | |
| 7,241,049 | B2 | 7/2007 | Lin et al. | |
| 2001/0042644 | A1 * | 11/2001 | Nishiyama et al. | 175/371 |
| 2004/0031625 | A1 * | 2/2004 | Lin et al. | 175/371 |
| 2007/0158114 | A1 | 7/2007 | Zahradnik et al. | |
| 2009/0014217 | A1 | 1/2009 | Zahradnik et al. | |
| 2009/0117372 | A1 * | 5/2009 | Zhuk et al. | 428/336 |

FOREIGN PATENT DOCUMENTS

WO 2006093319 A1 9/2006

OTHER PUBLICATIONS

Handbook of Hard Coatings, Deposition Technologies, Properties and Applications, pp. 4-7 and pp. 60-65, Edited by Rointan F. Bunshah, University of California, Los Angeles, California, Noyes Publications, Park Ridge, New Jersey, William Andrew Publishing, LLC, Norwich, New York.

Zhuk, Yuri N., "Hardide TM: advanced nano-structured CVD coating," Int. J. Microstructure and Materials Properties, vol. 2, No. 1, 2007, Copyright 2007 Inderscience Enterprises Ltd., pp. 90-98.

* cited by examiner

*Primary Examiner* — Brad Harcourt

(74) *Attorney, Agent, or Firm* — Bracewell & Giuliani LLP

(57) ABSTRACT

A roller cone bit is provided that includes a wear resistant coating applied to a bearing shaft, which is attached to a roller cone. The wear resistant coating can be a tungsten/tungsten carbide composite applied by chemical vapor deposition.

21 Claims, 10 Drawing Sheets

EARTH BORING BIT WITH WEAR RESISTANT BEARING AND SEAL

RELATED APPLICATIONS

This application is a continuation-in-part application of U.S. patent application Ser. No. 12,172,364, filed Jul. 14, 2008, which claims priority to and the benefit of U.S. Provisional Application Ser. No. 60/949,756, filed Jul. 13, 2007, and also claims priority to and the benefit of co-pending U.S. Provisional Application Ser. No. 61/041,621, filed Apr. 2, 2008, the full disclosure of which is hereby incorporated by reference herein.

BACKGROUND OF THE INVENTION

1. Field of the Invention

The present invention relates generally to drill bits for drilling into a subterranean formation, and more specifically to drill bits for drilling into a subterranean formation that include a wear resistant coating applied to the inner surface of the drill bit.

2. Description of Related Art

Rotary-type drill bits include both rotary drag bits and roller-cone bits. Typically, in a rotary drag bit, fixed cutting elements are attached to the face of the drill bit. In a roller-cone arrangement, the bit typically has three cones, each independently rotatable with respect to the bit body supporting the cones through bearing assemblies. The cones carry either integrally formed teeth or separately formed inserts that provide the cutting action of the bit.

The roller cones are typically attached to a bearing shaft that extends in a generally inward and downward orientation relative to the leg of the drill bit. Rotation of the roller cone is generally about an axis defined by the bearing shaft. The roller cone typically contacts the bearing shaft at a plurality of interior surfaces of the roller cone. The force applied to the drill bit during drilling operations is transmitted through the drill bit and to the interior surfaces of the roller cone and the bearing shaft.

While hardened and wear resistant coatings have been previously applied to the outer wear surfaces of drill bits, such as for example, the cutting elements, the interior wear surfaces of drill bits generally do not receive these surface treatments. Wear on the interior contacting surfaces can lead to the deterioration of the interior of the roller cone and/or the bearing shaft it contacts, thus leading to the need to replace the drill bit. Thus a need exists for a wear resistant surface coating to be applied to the surfaces of the interior of the roller cone and/or bearing shaft.

SUMMARY OF THE INVENTION

The present invention provides a rotary-type drill bit for drilling subterranean formations and method for malting the same. The bit according to the present invention includes a surface treatment for the interior portions of the drill bit.

In one aspect, a drill bit for drilling subterranean formations is provided. The drill bit includes a body including at least one leg, a cantilevered bearing shaft and a roller cone. The bearing shaft defines a longitudinal axis including a base formed at the at least one leg and having a substantially cylindrical surface extending from the base along the longitudinal axis. The roller cone is disposed about the bearing shaft for rotation about the longitudinal axis. The roller cone includes an exterior surface for contacting the subterranean formation and an interior surface disposed about the bearing shaft. The interior surfaces of the rolling cone bearing assembly include a wear resistant surface treatment. In certain embodiments, the wear resistant surface treatment includes a tungsten/tungsten carbide coating. In certain embodiments, the drill bit further includes a seal element disposed circumferentially about the base of the bearing shaft.

In another aspect, a drill bit for drilling a subterranean formation is provided. The drill bit includes at least one leg and a cantilevered bearing shaft having a base formed on the at least one leg and having a substantially cylindrical surface extending from the base defining a longitudinal axis. A roller cone is disposed about the bearing shaft and configured to rotate about the longitudinal axis, wherein the roller cone includes an exterior surface for contacting the subterranean formation and an interior surface disposed about the bearing shaft. At least a portion of an exterior surface of the bearing shaft includes a tungsten/tungsten carbide coating.

In certain embodiments, the bearing shaft further includes an indentation adapted to receive a bearing shaft element, and the drill bit further includes a bearing shaft element being secured in the indentation in the bearing shaft, wherein said tungsten/tungsten carbide coating is applied to an exterior surface of said bearing shaft element.

In another aspect, a drill bit for drilling subterranean formations is provided. The drill bit includes at least one leg and a cantilevered bearing shaft that includes a base formed at the at least one leg and having a substantially cylindrical surface extending from the base defining a longitudinal axis. The bearing shaft includes a lateral side surface and at least one thrust face located at a distal end thereof, wherein the lateral side surface includes an indentation formed substantially aligned with the longitudinal axis. A bearing shaft element is secured in the bearing shaft indentation. A roller cone is disposed about the bearing shaft and configured to rotate about the longitudinal axis, wherein the roller cone has an exterior surface that includes a plurality of cutting elements for contacting the subterranean formation and an interior surface disposed about the bearing shaft. The bearing shaft further includes an annular shaft seal groove formed at the base. A shaft seal ring is disposed within the annular shaft seal groove. At least a portion of an exterior surface of the bearing shaft element includes a wear resistant surface treatment applied thereto, said wear resistant surface coating comprises a vapor deposited tungsten compound. Optionally, the drill bit can further include a bearing race disposed circumferentially about a distal end of the bearing shaft; and a plurality of locking balls disposed within the bearing race, said locking balls having a surface and being operable to secure the cone on the bearing shaft, wherein at least one of the bearing race or the plurality of locking balls comprise a wear resistant coating applied to the surface thereof. Optionally, the drill bit can further include a plurality of rollers positioned about the lateral surface of the bearing shaft, wherein an outer surface of the plurality of rollers includes a wear resistant coating applied to the surface thereof. Optionally, the sliding surface of the shaft seal ring can include a wear resistant coating.

In certain embodiments, the wear resistant surface coating is applied to an exterior surface of the bearing shaft element by chemical vapor deposition. In other embodiments, the wear resistant surface coating is applied to an exterior surface of the bearing shaft element by chemical vapor deposition and then secured to the bearing shaft by means of brazing, gluing, soldering or welding. The wear resistant coating has a thickness of between about 5 and 300 μm.

In another aspect, a method for preparing a rotary type drill bit having a wear resistant coating applied to the interior surface is provided. The method includes the steps of providing a rotary drill bit that includes at least one bearing shaft and at least one roller cone, and applying a wear resistant coating to the surfaces of the bearing shaft that contact the interior surfaces of the roller cone. In certain embodiments, the wear resistant coating is applied to the lateral surfaces of the bearing shaft. In certain embodiments, the wear resistant coating is applied to the surface of the bearing shaft that contacts the sealing element. In certain embodiments, the wear resistant coating is applied to the surface of the bearing shaft by chemical vapor deposition. In certain embodiments, the wear resistant coating is a tungsten/tungsten carbide composite. In certain embodiments, the wear resistant coating is Hardide™.

In another aspect, a drill bit for drilling subterranean formations is provided. The drill bit includes at least one leg and a cantilevered bearing shaft that includes a base formed on the at least one leg. The bearing shaft includes a substantially cylindrical surface extending from the base to define a longitudinal axis. The bearing shaft also includes lateral side surfaces and at least one thrust face located at a distal end thereof. The drill bit further includes a roller cone disposed about the bearing shaft and configured to rotate about the longitudinal axis, the roller cone having an exterior surface comprising a plurality of cutting elements for contacting the subterranean formation and an interior surface disposed about the bearing shaft. The drill bit further includes an annular shaft seal groove formed at the base of the bearing shaft, and a shaft seal ring disposed within the annular shaft seal groove. At least a portion of the lateral surface of the bearing shaft includes a wear resistant surface treatment applied thereto and at least a portion of the annular shaft seal groove includes a wear resistant surface treatment applied thereto.

In another aspect, a method for preparing a drill bit is provided. The method includes the steps of providing a third, wherein the third includes at least a portion of a drill bit leg and a cantilevered bearing shaft formed at one end of the drill bit leg. The bearing shaft has a substantially cylindrical exterior surface, wherein the exterior surface of the bearing shaft includes an indentation formed substantially aligned with the longitudinal axis. A bearing shaft element is prepared wherein the bearing shaft element includes a wear resistant tungsten/tungsten carbide coating. The bearing shaft element is prepared by placing said element into a deposition chamber, depositing the coating on the surface thereof, and removing the coated bearing shaft element from the deposition chamber. The coated bearing shaft element is installed into the indentation in the bearing shaft. The steps further include securing a roller cone to the bearing shaft; and welding three thirds together to provide a drill bit.

In certain embodiments, the wear resistant coating includes a first layer comprising tungsten and a second layer comprising tungsten carbide. In alternate embodiments, the wear resistant coating is a multilayer coating comprising alternating layers of tungsten and tungsten carbide. In yet other embodiments, the first and second layers have a thickness ratio of between 1:1 and 1:600. Optionally, the bearing shaft includes at least one thrust surface, wherein the tungsten/tungsten carbide coating is applied to the at least one thrust surface.

DETAILED DESCRIPTION

Figure 1:
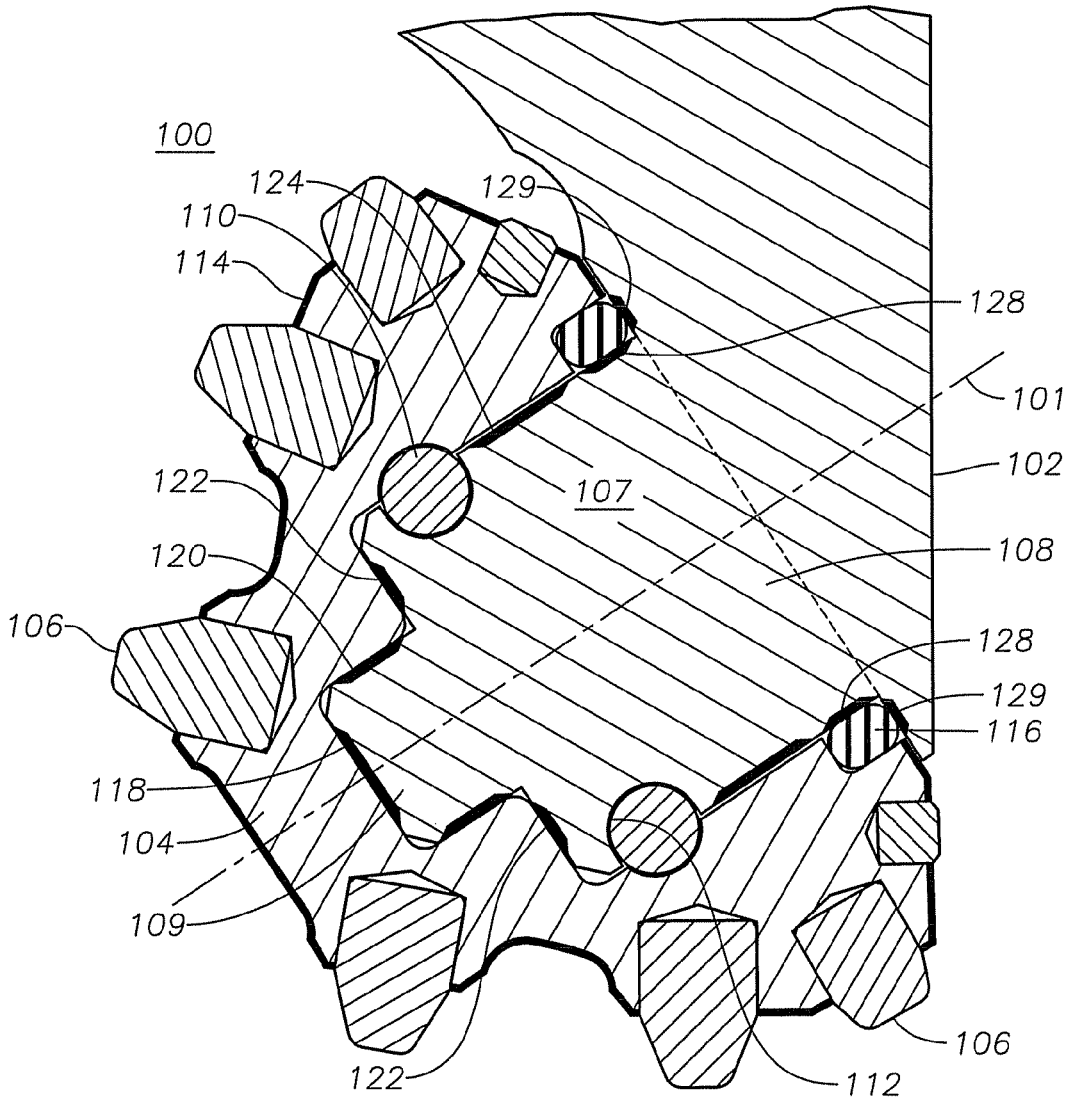
FIG. 1 is a partial cross sectional view of a roller cone drill bit according to one embodiment of the invention.

Although the following detailed description contains many specific details for purposes of illustration, one of ordinary skill in the art will appreciate that many variations and alterations to the following details are within the scope and spirit of the invention. Accordingly, the exemplary embodiments of the invention described herein are set forth without any loss of generality to, and without imposing limitations thereon, the present invention.

Various materials known in the art can be used to provide surface treatments for the exterior surfaces of drill bits. Surface treatments can be applied for a variety of reasons, such as for example, for increased life time of the exposed parts, and/or to reduce adhesion of various substances to the exterior surfaces of the drill bit. The present invention relates to the application of surface treatments to the interior contacting surfaces of the drill bit. The use of wear resistant coatings to the interior surface of the roller cone drill bits can result in increased life time of the bearings and seals.

The surface coatings of the present invention can be applied by a variety of techniques, including but not limited to, physical vapor deposition, chemical vapor deposition, and like processes. Physical vapor deposition processes can include, but are not limited to, evaporation, sputtering and laser ablation. Chemical vapor deposition (CVD) processes generally include the deposition of a solid from the vapor phase onto a substrate that optionally may be heated or pretreated by other means to enhance the reaction of the material being deposited with the substrate surface.

One exemplary surface coating is Hardide™, a low temperature CVD tungsten/tungsten carbide coating that can be applied to the surface of a target substrate by chemical vapor deposition. The coating consists of tungsten carbide nanoparticles that are dispersed in a metal tungsten matrix, resulting in a material having an enhanced hardness of between about 1100 Hv and 1800 Hv. Typically, the tungsten carbide nano-particles have a diameter ranging from about 1-10 nm. The wear resistance of Hardide™ coatings (measured according to ASTM G65 standard) is up to about 100 times greater than wear-resistant steel, up to about 12 times greater than hard chrome, and up to about 3 times greater than cemented tungsten carbide. In certain embodiments, the Hardide™ coating can include free carbon, which can increase the lubricity of the surface.

The Hardide™ coating is preferably applied to a substrate using a CVD process. In a typical CVD process for the deposition of composite coatings, the substrate is heated in a reaction chamber, preferably a vacuum chamber, and a mixture of gas reagents is then introduced into this chamber. By varying the composition of the reaction mixture and of the parameters of the process (e.g., the temperature of the substrate, the composition of the reaction mixture, flow rate of the gaseous reagents, total pressure in the reaction mixture, temperature of the gases supplied, etc.), it is possible to obtain a variety of coatings. Various techniques for the application of the Hardide™ coating are described in U.S. Pat. No. 6,800,383, the disclosure of which is hereby incorporated by reference in its entirety.

The construction material with the deposited composition coating has an internal tungsten layer having a thickness between approximately 0.5 μm and 300 μm. The thickness of the external layer can be between approximately 0.5 μm and 300 μm. The ratio of thicknesses of the internal and external layers ranges from approximately 1:1 to 1:600. In certain embodiments, the coating can have a thickness of between about 5 μm and 100 μm. In certain embodiments, the coating has a thickness of between about 10 μm and 50 μm, and in other embodiments the coating can have a thickness of between about 50 μm and 90 μm.

In accordance with this invention, the Hardide™ coating can be deposited utilizing a chemical reactor onto a substrate from a gaseous phase that includes tungsten hexafluoride, hydrogen, a carbon-containing gas (e.g. propane), and, optionally, an inert gas (e.g. argon). The carbon-containing gas is preferably thermally activated before being introduced into the reactor by heating it to between about 500 and 850° C. The pressure in the reactor ranges from about 2 to 150 kPa. The substrate is typically heated to temperature of between about 400 and 900° C. The ratio of carbon-containing gas to hydrogen ranges from about 0.2 to 1.7, and the ratio of tungsten hexafluoride to hydrogen ranges from about 0.02 to 0.12.

Within the stated limits, the parameters of the process are determined depending on which carbide or mixture of carbides with each other or with tungsten or with carbon is required to be produced. For example, to produce tungsten monocarbide (WC), the preliminary thermal activation of the carbon-containing gas is conducted at a temperature of between about 750 and 850° C. The ratio of propane to hydrogen is set in the interval about 1.00 and 1.50, and the ratio of tungsten to hydrogen in the interval about 0.08-0.10.

In certain embodiments, tungsten carbide or mixtures of carbides and tungsten can be superimposed on a tungsten layer previously deposited on the substrate. In certain embodiments, bilaminar coatings (i.e., an internal layer of tungsten and an external layer containing one or more tungsten carbides), and multilayer coatings having alternating layers of tungsten and layers containing tungsten carbides can be applied to the interior surfaces of the roller cone drill bit.

Chemical vapor deposition of the Hardide™ coating can include of the following steps. A degreased and contaminant free substrate is place into a heated direct-flow chemical reactor. The reactor is evacuated and hydrogen or argon is supplied to the reactor. The reactor is heated to the required temperature, which is maintained for between about 0.5 and 1 hour. After this, the required hydrogen flow rate, total pressure in the reactor, and rate of tungsten hexafluoride flow are set. After an initial internal tungsten layer is deposited, a new pressure is set and a certain flow rate of the carbon-containing gas (e.g. propane) is set. A multilayer composition coating is obtained by repeating the operation. The substrate is maintained at constant temperature for between about 0.5 and 1 hour. The reactor is then brought to room temperature under hydrogen or argon atmosphere. The hydrogen or argon gas flow is terminated; the reactor is evacuated, and vented to air. The substrate with composite coatings may then be removed from the reactor.

FIG. 1 shows a partial cross sectional view of embodiment of a roller cone drill bit bearing according to the present invention. The drill bit 100 includes leg 102 coupled to a cone 104 via bearing shaft 107. Bearing shaft 107 extends from leg 102 and has an axis of rotation 101. Cone 104 includes a plurality of cutting inserts 106. Bearing shaft 107 includes base 108 and head 109, wherein the base and head of the bearing shaft are substantially cylindrical, and wherein the base has a larger diameter than the head. A plurality of locking balls 110 are retained in bearing race 112, which operably retains cone 104 on bearing shaft 107. Primary thrust face 122 is located on bearing shaft 107. Secondary thrust face 118 is positioned at the distal end of bearing shaft head 109. Seal 116 is positioned between end of base 108 of bearing shaft 107, proximate to leg 102. Seal 116 can be an o-ring or the like.

In accordance with the present invention, a wear resistant surface coating can be applied to the outer surface of bearing shaft 107 where the shaft contacts the interior cavity of cone 104. Specifically, a wear resistant surface coating can be applied to lateral surface 120 of bearing shaft head 109 and lateral surface 124 of bearing shaft base 108. A wear resistant surface coating can be also applied to primary thrust face 122 of bearing shaft 107. A wear resistant surface coating can be applied to lateral surface 128 of bearing shaft 107, which contacts seal 116. Additionally, the coating can be applied to any surface seal 116 contacts, such as back face plane 129 or forward face plane 130. The hardened surfaces can include materials, such as, Hardide™, SiC, TiN, diamond-like carbon (DLC), and the like. In certain embodiments employing a thrust washer, a wear resistant coating can be applied to the top and bottom surfaces of the washer. In certain embodiments, cone 104 can include a wear resistant surface coating applied to outer surface 114 of the cone. In certain embodiments, the wear resistant coating can be applied to the interior cavity of the cone 104.

Figure 2:
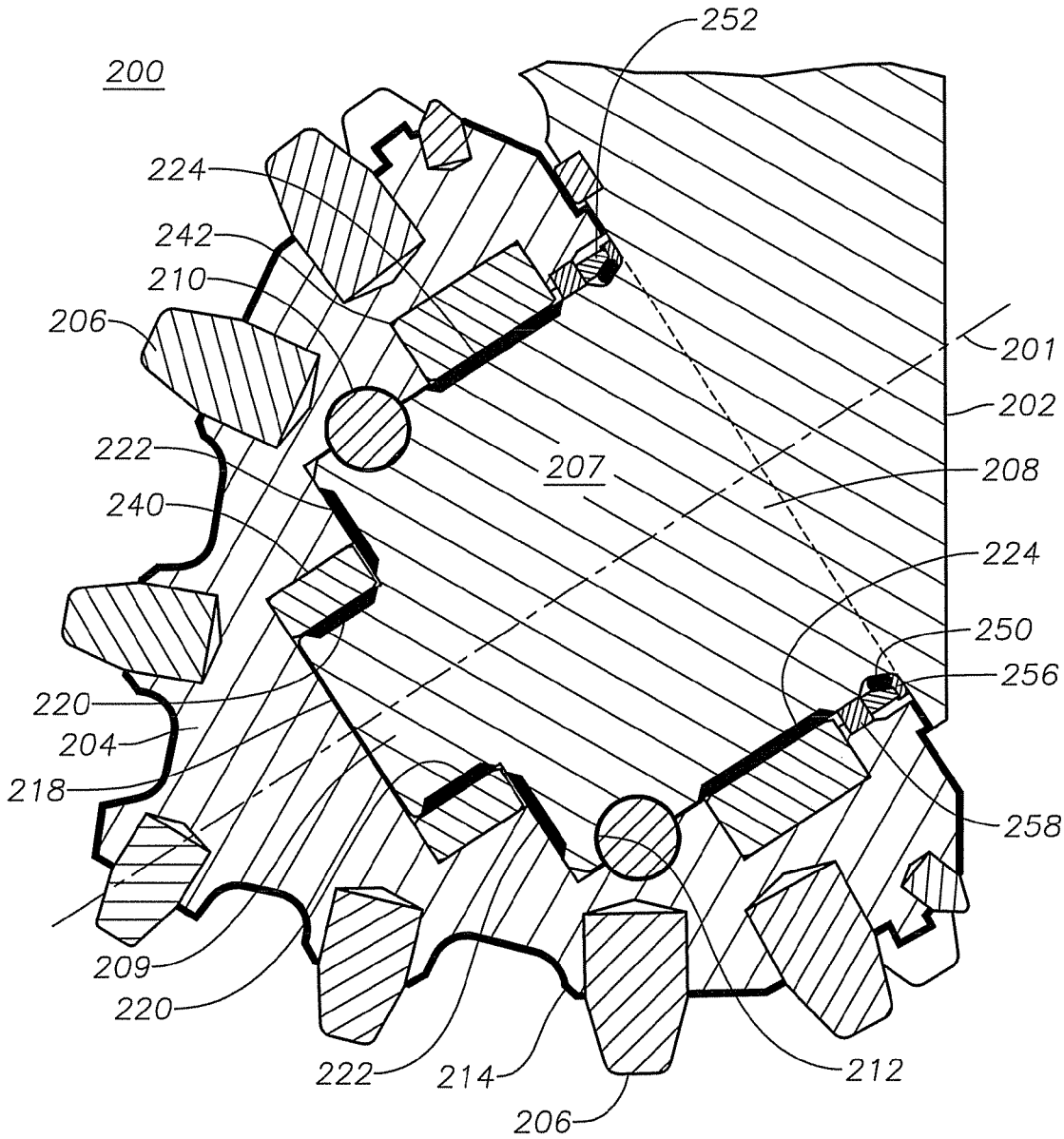
FIG. 2 is a partial cross sectional view of a roller cone drill bit according to another embodiment of the invention.

FIG. 2 shows a partial cross sectional view of a roller cone drill bit having rolling bearing elements. Roller cone drill bit 200 includes leg 202 and includes bearing shaft 207 and cone 204, wherein the cone has an axis of rotation 201. Cone 204 is coupled to bearing shaft 207 and includes plurality of cutting inserts 206. Bearing shaft 207 includes base 208 and head 209, wherein the base and head of the bearing shaft are substantially cylindrical, and the base has a larger diameter than the head. A plurality of locking balls 210 are retained in bearing race 212, which operably retains cone 204 on bearing shaft 207. A plurality of rollers 240 are positioned about lateral surface 220 of head 209 of bearing shaft 207. Similarly, a plurality of rollers 242 are positioned about lateral surface 224 of base 208 of bearing shaft 207. Primary thrust face 222 is located on bearing shaft 207. Secondary thrust face 218 is located at the distal end of head 209 of bearing shaft 207.

Cone 204 includes a mechanical seal between the cone and bearing shaft 207, proximate to the leg 202. The seal includes first sealing element 250, which can be an o-ring or like material. Second sealing element 256 is provided and is preferably an elastomeric material. Shaft seal ring 252 is provided and is circumferentially positioned about bearing shaft 207 between leg 202 and rollers 242. Shaft seal ring 252 is in sliding contact with seal insert 258. A wear resistant coating can be applied to the exterior surface of bearing shaft 207 where the shaft contacts first sealing element 250.

A wear resistant surface coating can be applied to the outer surface of bearing shaft 207 at lateral surfaces 220 and 240, where the shaft contacts rollers 240 and 242, respectively. Specifically, a wear resistant surface coating can be applied lateral surface 220 of bearing shaft head 209 and lateral surface 224 of bearing shaft base 208. A wear resistant surface coating can also be applied to thrust face 222 of bearing shaft 207. Cone 204 can also include wear resistant surface coating 214 applied to the outer surface of the cone. In certain embodiments, a wear resistant coating can be applied to the interior cavity of cone 204.

Figure 3:
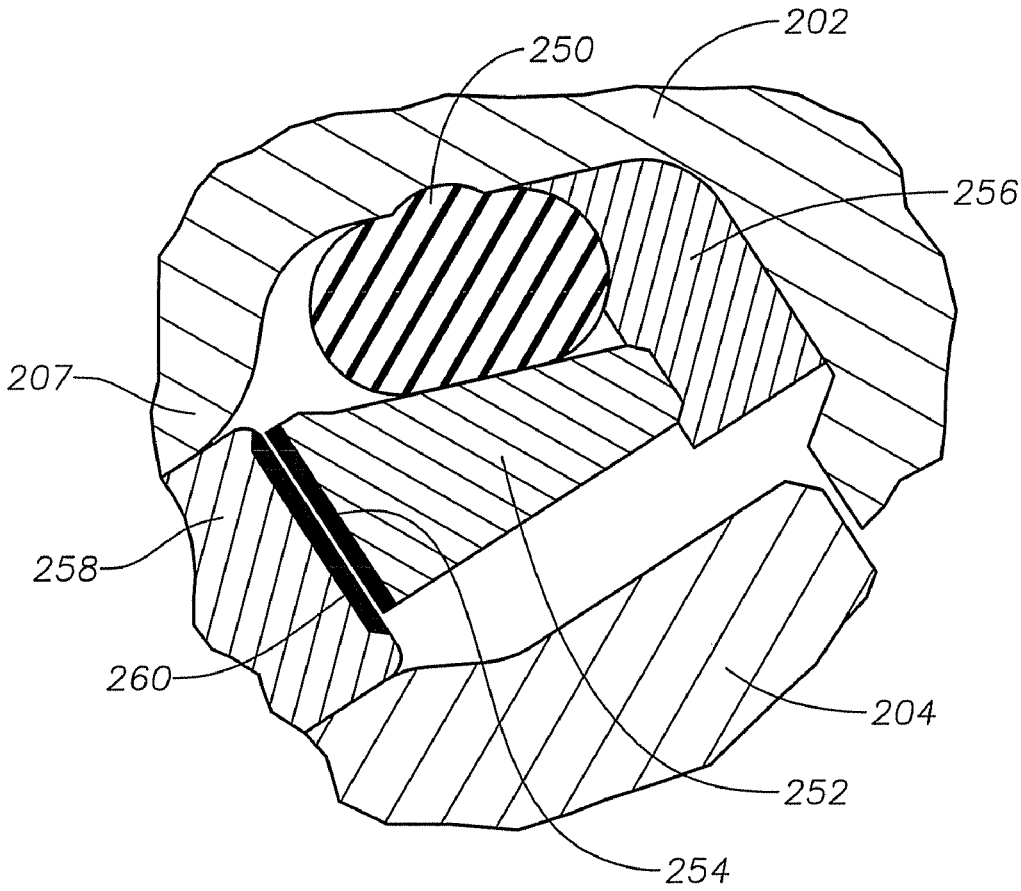
FIG. 3 is a partial cross sectional view of one embodiment of the mechanical face seal for a roller cone drill bit.

FIG. 3 is a partial cross sectional view of one embodiment of the mechanical face seal of a roller cone drill bit having roller bearings. First sealing element 250, which can be for example an o-ring, is positioned between rigid shaft ring 252 and bearing shaft 207. Second sealing element 256 is positioned adjacent to first sealing element 250 and bearing shaft 207, and at the proximate end of rigid shaft ring 252. A wear resistant surface coating according to the present invention can be applied to distal end surface 254 of rigid shaft ring 252 where the rigid shaft ring contacts seal insert 258. In certain embodiments, the wear resistant coating can also be applied to contacting surface 260 of seal insert 258, where the seal insert contacts rigid shaft ring 252. In certain other embodiments, the wear resistant coating can be applied to one or both of contacting surfaces 254 and 260.

Figure 4:
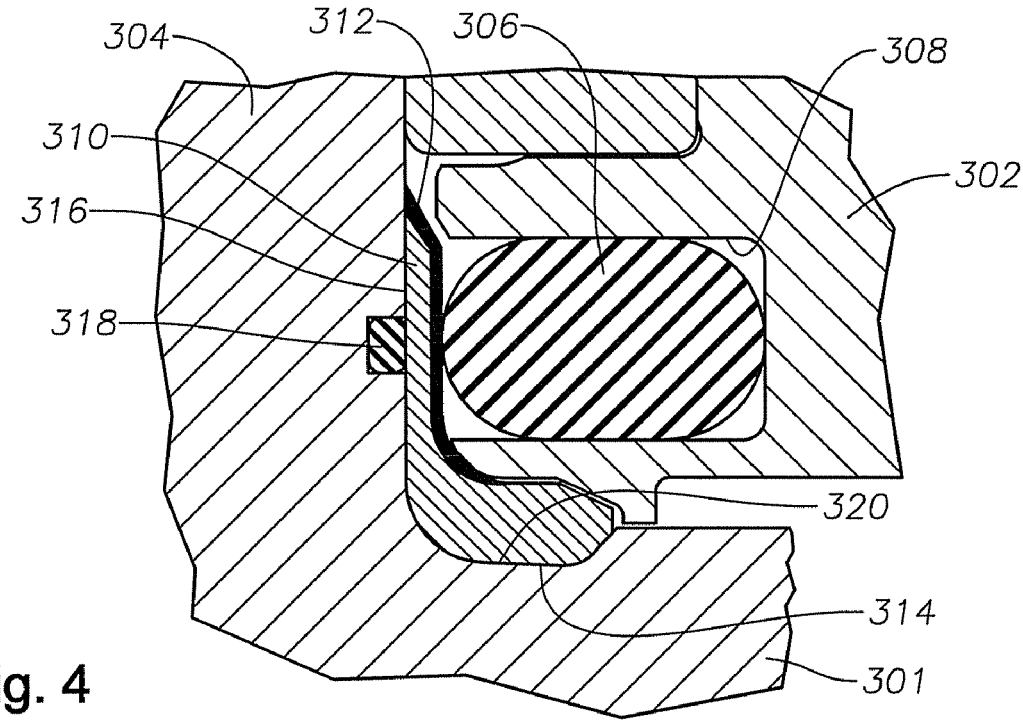
FIG. 4 is a schematic view of one embodiment of a seal design for a seal counter surface.

FIG. 4 illustrates a schematic view of a seal design for use on a roller cone drill bit having a floating sleeve. The drill bit consists of roller cone 302 positioned about bearing shaft 304, which is connected to leg 301. Cone 302 includes an outer surface and an interior cavity, which are formed to operably engage bearing shaft 304. The seal between cone 302 and bearing shaft 304 can include elastomeric seal 306 positioned in seal groove 308, formed near the entrance or mouth of the interior cavity of the cone. The seal also includes rigid floating sleeve 310 positioned on bearing shaft 304 at the junction with drill bit leg 301. Rigid floating sleeve 310 preferably has an L-shaped cross-section, having cylindrical portion 316 that extends around the lateral edge of bearing shaft 304 and flange portion 314 that extends outward from the cylindrical portion and engages annular recess 320. Inner seal 318 is located in a groove formed in bearing shaft 304, and seals against the inner diameter of cylindrical portion 316 of floating sleeve 310. Inner seal 318 can be, for example, an elastomeric o-ring, and preferably has a uniform cross-sectional thickness about the circumference of the seal. Floating sleeve 310 typically remains stationary with bearing shaft 304; however some rotation or slippage may occur. Wear resistant coating 312 can be applied to the exterior face of cylindrical portion 316 of floating sleeve 310, at the location where the sleeve contacts elastomeric seal 306 and interior cavity of the cone 302. In certain embodiments, a wear resistant coating can be applied to the interior surface of floating sleeve 310, where the sleeve contacts bearing shaft 304.

Figure 5:
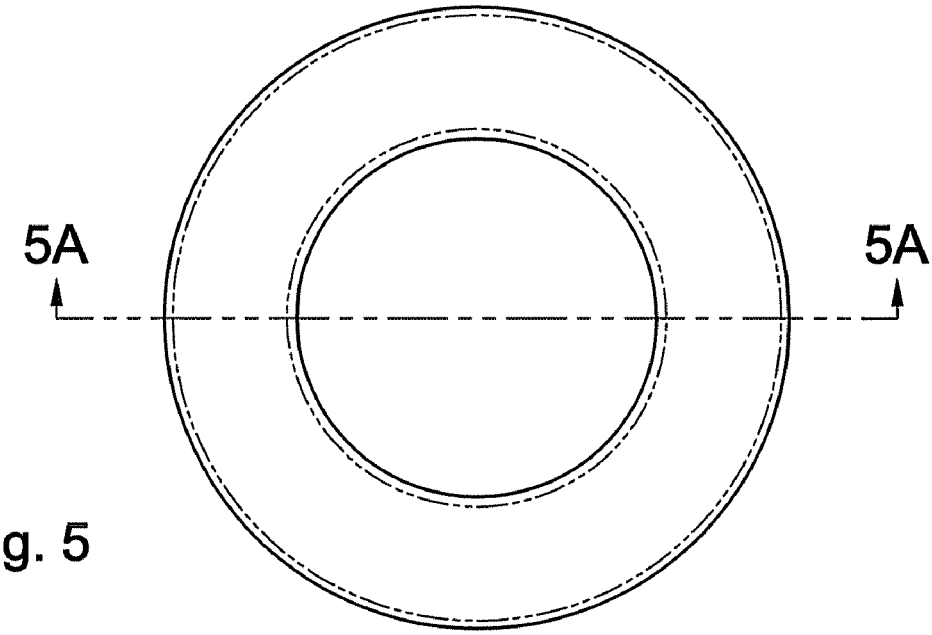
FIG. 5 is a schematic view showing thrust bearing washer having the top and bottom surfaces coated with a hardened surface according to the present invention.
Figure 5A:
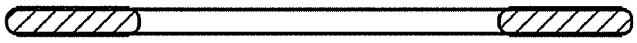

FIG. 5 is a schematic view of a thrust bearing washer having a wear resistant surface coating applied to the load bearing surfaces of the washer. In certain embodiments, the use of floating bearing elements having a wear resistant coating applied to at least of the surfaces are advantageous due to the fact that they have two load bearing sliding surfaces, i.e., the top and bottom surfaces of the washer. The use of a bearing washer can help to eliminate thrust bearing failures in high slide speed applications with large diameter drill bits. A wear resistant surface coating can be applied by known techniques, such as for example, by physical or chemical vapor deposition.

As described herein, methods for the preparation of drill bits that include a wear resistant surface are provided. The wear resistant surface is generally described as at least one of the contacting surfaces between the interior of the roller cone and the exterior of the bearing shaft. Because the coated surfaces are internal surfaces, deposition of the wear resistant coating must be applied prior to assembly of the drill bit.

Typically, the drill bit body is prepared as three separate pieces or "thirds", which after assembly, are welded together to make the drill bit. The manufacture of a drill bit having wear resistant surfaces according to the methods described herein includes the steps of providing a third, wherein the third includes a drill bit leg and a cantilevered bearing shaft formed on the end the drill bit leg. The third may then be masked off, leaving exposed only the surfaces to which the wear resistant coating is desired to be applied. The masked third may then be positioned in a vacuum deposition chamber, and the desired materials may be deposited thereon. Preferably, at least a portion of the bearing shaft is left exposed and coated with a wear resistant coating. In certain embodiments, the chamber may be heated and maintained at a reduced pressure during the deposition. One preferred coating for the bearing shaft is a tungsten/tungsten carbide coating. Following deposition of a wear resistant coating of desired thickness, the third having the wear resistant coating is removed from the deposition chamber, the masking is removed, and the drill bit is assembled. Assembly of the drill bit includes the steps of positioned a roller cone on the bearing shaft having the wear resistant surface coating applied thereto, securing the roller cone to the bearing shaft by inserting the locking balls into the locking ball race, and welding three similarly configured thirds together to achieve the drill bit, such as for example, by electron beam welding.

In an alternate embodiment, the manufacture of a drill bit having wear resistant surfaces according to the methods described herein can include the step of providing a masked roller cone, wherein the exposed surfaces of the roller cone are desired to be coated with a wear resistant coating. Preferably, the interior surfaces of the roller cone, which contact a bearing shaft when assembled, are coated with a wear resistant coating. The masked roller cone may then be positioned in a vacuum deposition chamber, and the desired materials may be deposited thereon. In certain embodiments, the chamber is heated and maintained at an elevated pressure, during the deposition of the coating. Following deposition of surface coating of desired thickness, the roller cone may be removed from the deposition chamber, the masking removed, and the drill bit assembled. During assembly, the roller cone having the wear resistant coating applied thereto is positioned on a bearing shaft and locking balls are inserted into a locking ball race, thereby securing the roller cone to the bearing shaft. Typically, the drill bit is prepared as the separate pieces or "thirds", which after securely fastening the roller cones to the bearing shaft, are welded together to make the drill bit.

In certain embodiments, a sleeve can be installed on the bearing shaft, wherein the sleeve includes a wear resistant coating, preferably a tungsten/tungsten carbide coating, applied to the exterior surface. The use of sleeves in this manner is described below, with reference to FIGS. 6-15. Methods for application of the wear resistant coating on the surface of the sleeve are provided herein, and can include, but are not limited to, physical and chemical vapor deposition. In certain embodiments, the sleeve that includes a wear resistant coating can be secured to an indentation or channel in the bearing shaft that is adapted to receive said sleeve. As noted below, methods for affixing or securing the sleeve to the bearing shaft indentation include, but are not limited to, welding, brazing, gluing, soldering, combinations thereof, or the like.

Figure 6:
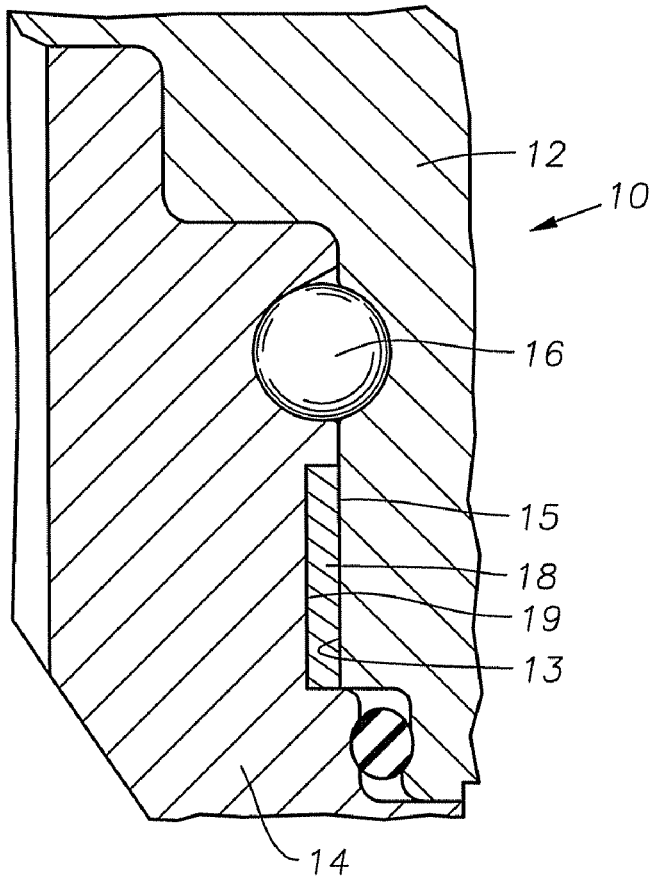
Fig. 6 (Prior Art)
FIG. 6 is a cross-sectional view of a portion of a roller cone bit.

FIG. 6 provides in a side cross-sectional view an example of a portion of a roller cone drill bit 10. In this embodiment, the roller cone 12 mates with the head portion 14. A set of balls 16 is provided in an annular opening formed between the cone 12 and the head 14 and serves as a cone-retention system. A secondary purpose of the balls 16 is to provide a rolling surface for facilitating rotation of the cone 12. Cone bearing surface 13 mates against and rotatably slides about head bearing surface 15. The respective surfaces (13, 15) must accommodate the high stress during the respective loading and rotation of these elements.

Figure 7:
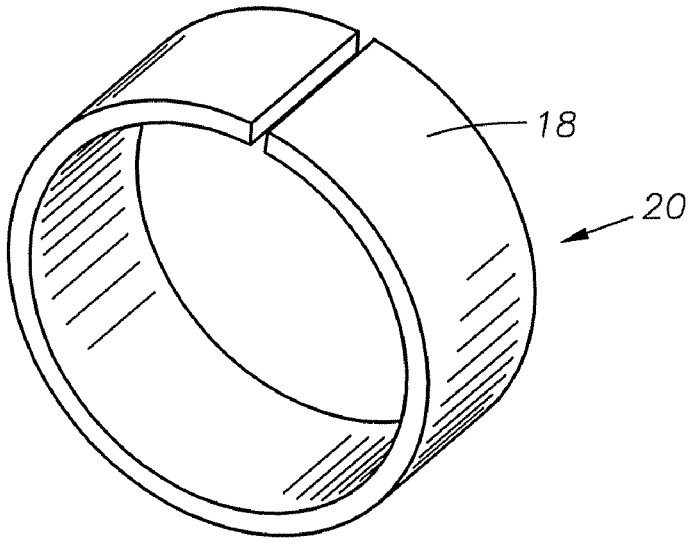
Fig. 7 (Prior Art)
FIG. 7 is a view of a bearing element with a single separation.

Traditionally, a journal bearing element 18 is disposed in a recess 19 circumferentially formed within the head section 14. The journal bearing element 18 accommodates the cone 12 rotation and the forces that the cone 12 may exert on the head section 14. The material used in forming the journal bearing element 18 varies; some are hard substances while others are soft, such as bronze and beryllium copper. In FIG. 7, an example of a journal bearing element 18 is illustrated in a perspective view. The journal bearing element 18 is not a continuous ring but includes a separation 20 along the circumference of the journal bearing element 18. The separation 20 allows the journal bearing element 18 to be temporarily deformed during installation so it can be placed in the recess 19. Thus, should the journal bearing element 18 become galled and adhere to either one of the cone bearing surface 13 or the head bearing surface in the recess 19; the cone 12 can still rotate relative to the head 14 because one of the two bearing surfaces (13,19) is still rotatable. While the embodiment of FIG. 6 does provide some redundancy in situations where seizing may occur between the journal bearing element 18 and one of the opposing surfaces (13, 19), journal bearing element 18 addition complicates the design with regards to tolerances. The invention described herein provides increased bearing precision and wear resistance over that of the prior art.

Figure 8:
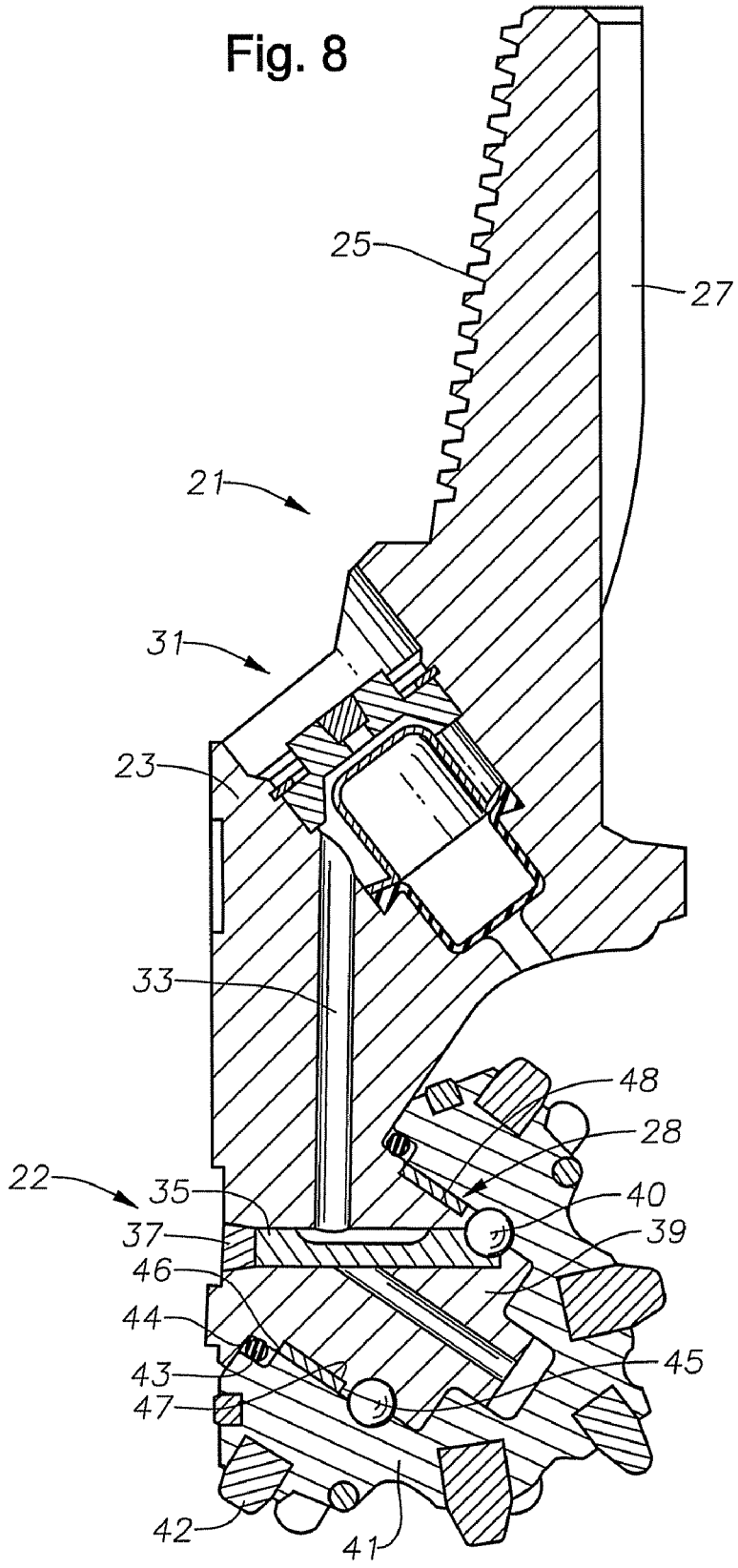
FIG. 8 is a sectional view of a bit body head section.

FIG. 8 is a partial sectional view of an earth-boring bit 21 having a journal bearing element 28, as described herein. While FIG. 8 only illustrates a single section, the bit 21 may comprise two or more sections welded together to form the composite bit 21. The earth-boring bit 21 has bit body 23 with a threaded upper portion 25 for connecting to a drill string member (not shown) and a leg section 22 having a cutting cone 41 attached thereon. A fluid passage 27 directs drilling fluid to a nozzle (not shown) that impinges drilling fluid against the borehole bottom to flush cuttings to the surface of the earth. A pressure compensating lubrication system 31 may optionally be contained within each section of the bit 21. A lubrication passage 33 extends downwardly to a ball plug 35, which is secured to the body 21 by a plug weld 37. A third lubrication passage (not shown) carries lubricant to a bearing surface between a bearing shaft 39, which is cantilevered downwardly and inwardly from an outer and lower region of the body 23 of the bit 21. The ball plug 37 retains a series of ball bearings 40 rotatably secured to the cutter cone 41 and to the bearing shaft 39. Dispersed in the cutter cone 41 are a plurality of rows of earth disintegrating cutting elements or teeth 42 securable by interference fit in mating holes of the cutter cone 41. An elastomeric O-ring seal 43 is received within a recess 44 formed in the journal bearing shaft 39.

Figure 9:
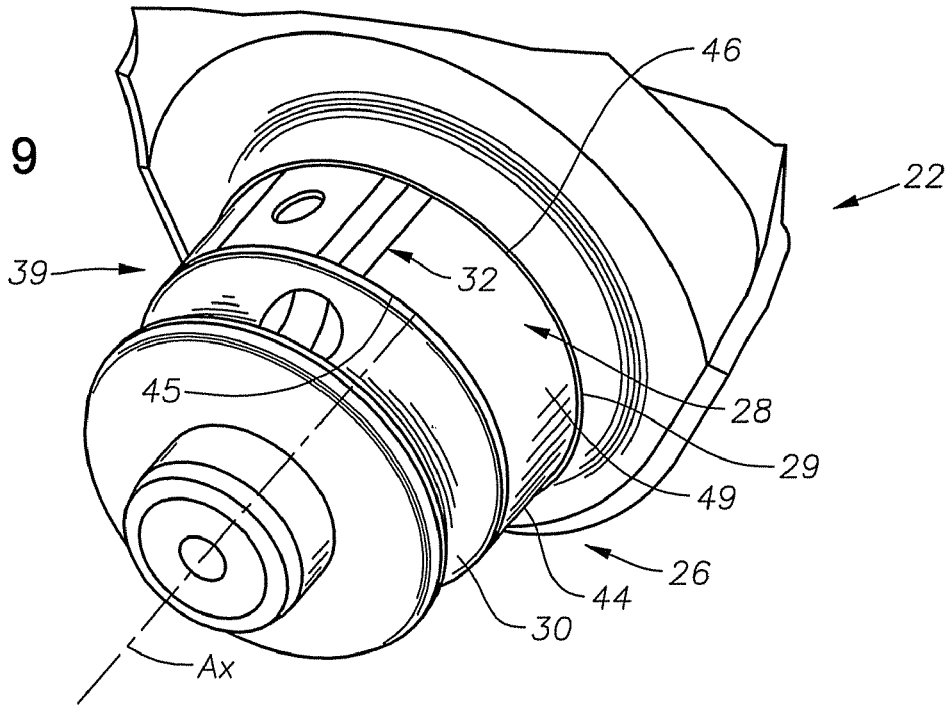
FIG. 9 is a perspective view of an embodiment of a bearing portion of a head section consistent with the present disclosure.

FIG. 9 provides a perspective view of an embodiment of a portion of the earth boring bit 21 of FIG. 8. FIG. 9 illustrates in more detail an example of a journal bearing portion of the leg section 22 in accordance with the present disclosure. The leg section 22 is shown in perspective view having the bearing shaft 39 which comprises a base for the cutter cone 41. The bearing shaft 39 includes a journal section 26 having a recess 44 circumscribing the outer circumference of the bearing shaft 39. The recess 44 includes a bearing surface 47 (FIG. 8) on its lower surface formed to receive a journal bearing element 28 thereon. Adjacent the journal section 26 is a ball race 30 formed to receive the ball bearings 40 connecting the leg section 22 to the cutter cone 41. In this embodiment, the journal bearing element 28 is a cylindrical body having an inner surface 48 (FIG. 8) that couples with the bearing surface 47. First and second lateral sides (45, 46) extend from the inner surface 48 and terminate at an outer surface 49. At least one separation 32 is shown along the circumference of the journal bearing element 28.

Figure 11:
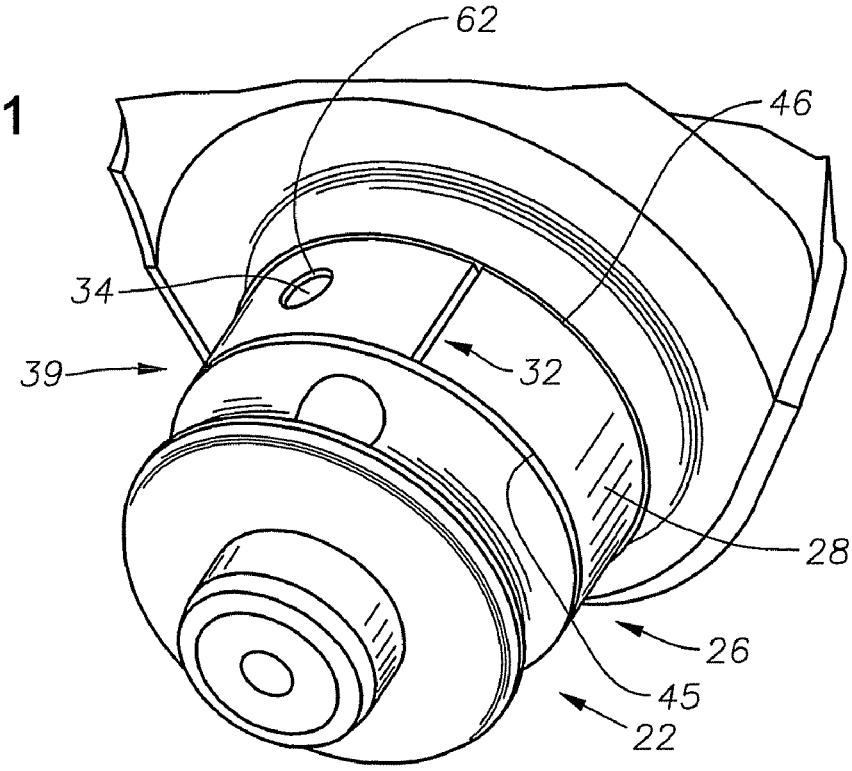
FIG. 11 is a perspective view of an embodiment of a bearing element coupled to a bearing shaft.
Figure 12:
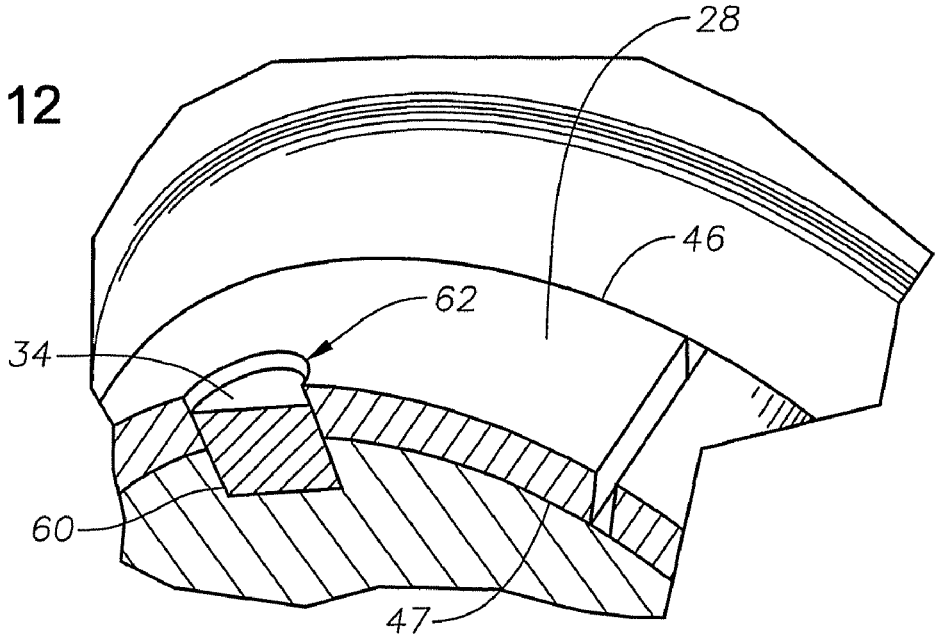
FIG. 12 is a perspective partial sectional view of the embodiment of FIG. 6.
Figure 14:
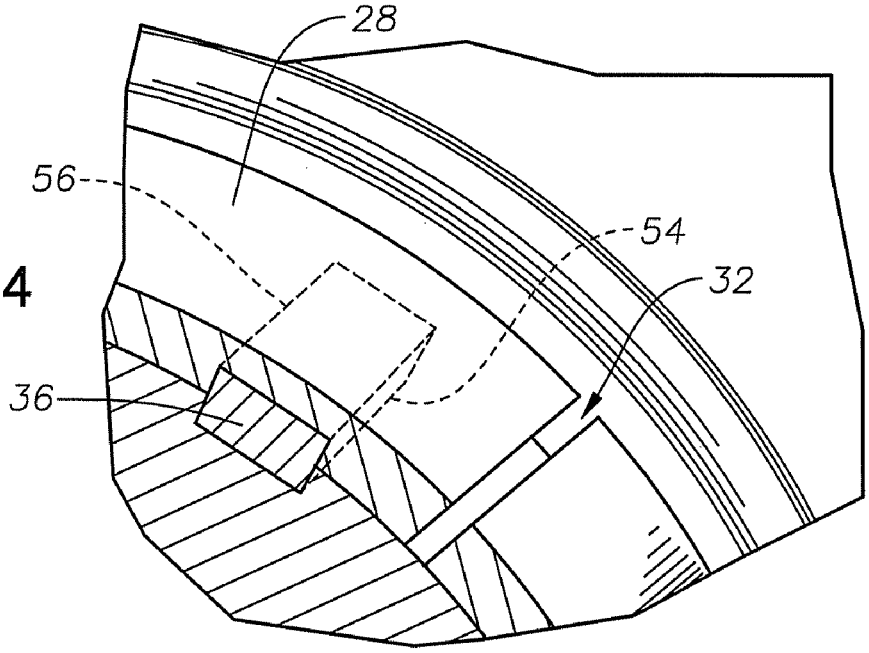
FIG. 14 is a perspective partial sectional view of a bearing element coupled to a journal.

The journal bearing element 28 may be affixed to the journal section 26 by means of brazing, gluing, soldering, or welding either individually or in combination with other coupling means. Optionally, the journal bearing element 28 may comprise multiple sections or members. Each individual member is curvilinear and having a radius of curvature that circumscribes the bearing shaft 39 when the members are arranged around the bearing surface of the bearing shaft 39. Within the scope of this disclosure, the term coupling means joining the journal bearing element 28 to a bearing shaft 39 where some or no degrees of freedom exist between the element 28 and the bearing shaft 39. Thus coupling includes preventing the journal bearing element 28 from sliding within the recess 44 circumferentially around the bearing shaft 39 but yet allowing the journal bearing element 28 to be removed from the bearing shaft 39. Coupling also includes preventing relative sliding but allowing axial movement as well as totally affixing the journal bearing element 28 to the bearing shaft. Coupling a single member of a multi-member journal bearing element 28 to the bearing surface 47 within the recess 44 precludes the other members from sliding when adjacent members abut at a split section 32. Optionally, the journal bearing element 28, or the individual members, may also be coupled to prevent sliding in a lateral direction FIG. 11 illustrates an alternative coupling element embodiment for coupling a journal bearing element 28 to the bearing shaft; in this embodiment a dowel 34 is inserted through a bore 62 formed in the journal bearing element 28. Illustrated in a perspective partial sectional view in FIG. 12, the bore 62 through the journal bearing element 28 registers with a corresponding bore 60 formed through the bearing surface 47 on the journal section 26. FIG. 14 is a perspective partial sectional view of a coupling device comprising a key 36 that couples the journal bearing element 28 to the journal section 26 (FIG. 9). The key 36 is inserted into a passage formed by aligning a channel 56 in the journal bearing element 28 with a channel 54 formed in the journal section 26 (FIG. 9).

Figure 13:
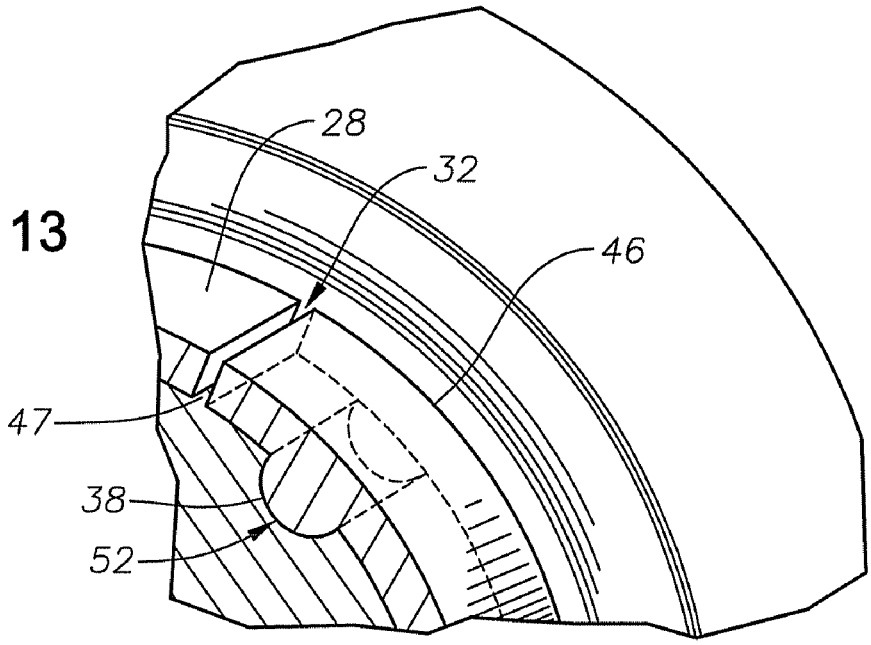
FIG. 13 is a perspective partial sectional view of a bearing element coupled to a journal.

Another coupling device embodiment is presented in perspective partial sectional view in FIG. 13. In this embodiment, a raised profile 38 having a semi-circular cross section is provided on the journal bearing element 28 inner circumference that protrudes into a similarly shaped indentation 52 on the journal section 26 (FIG. 9) outer circumference. Engaging the profile 38 with the indentation 52 couples the journal bearing element 28 with the journal section 26 to prevent circumferential sliding of the journal bearing element 28 over the journal section 26. The profile 38 and indentation 52 of FIG. 13 are not limited to semi-circular embodiments, but can include rectangular, triangular, elliptical, and other shapes. It should be pointed out that coupling the journal bearing element 28 to the journal section 26 may allow lateral tilting of the journal bearing element 28 with respect to the journal section 26. For example, although coupled, one of the first lateral side 45 (FIG. 11) or second lateral side 46 may experience radial movement away from the journal section 26. The coupling devices described herein can be disposed proximate or at the first and second lateral sides (45, 46) of the journal bearing element 28. Optionally, a substantial portion of the indentation/profile, channel/key, and bore/dowel configurations may reside between the first and second lateral sides (45, 46).

Figure 10:
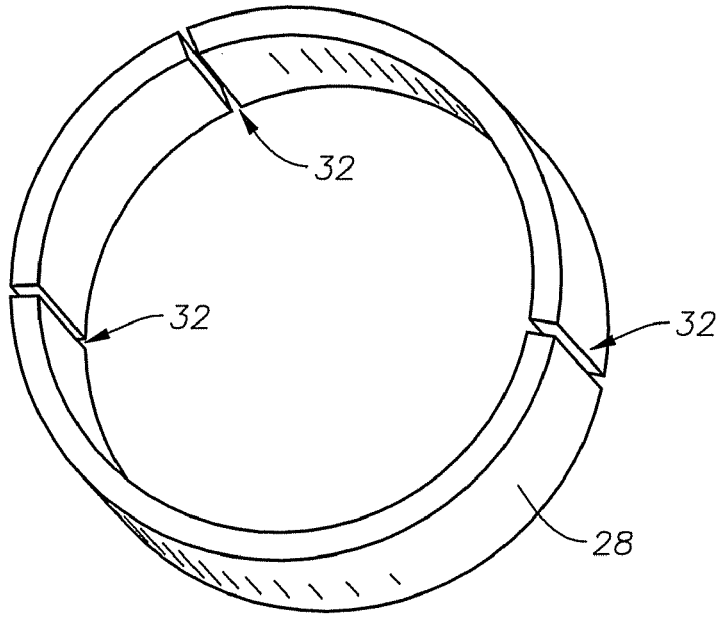
FIG. 10 is a view of a bearing element as embodied in the present disclosure.

FIG. 10 provides a view of an embodiment of a multi-section journal bearing element 28. In this embodiment, the journal bearing element 28 comprises three sections abutted at split sections 32. Thus coupling at least one of the sections to a corresponding bearing shaft 39 (FIG. 9) prevents the remaining sections from circumferential sliding. Optionally, the use of silver plating on the inner circumference of a corresponding cone may be employed with the journal bearing element 28 described herein.

Figure 15:
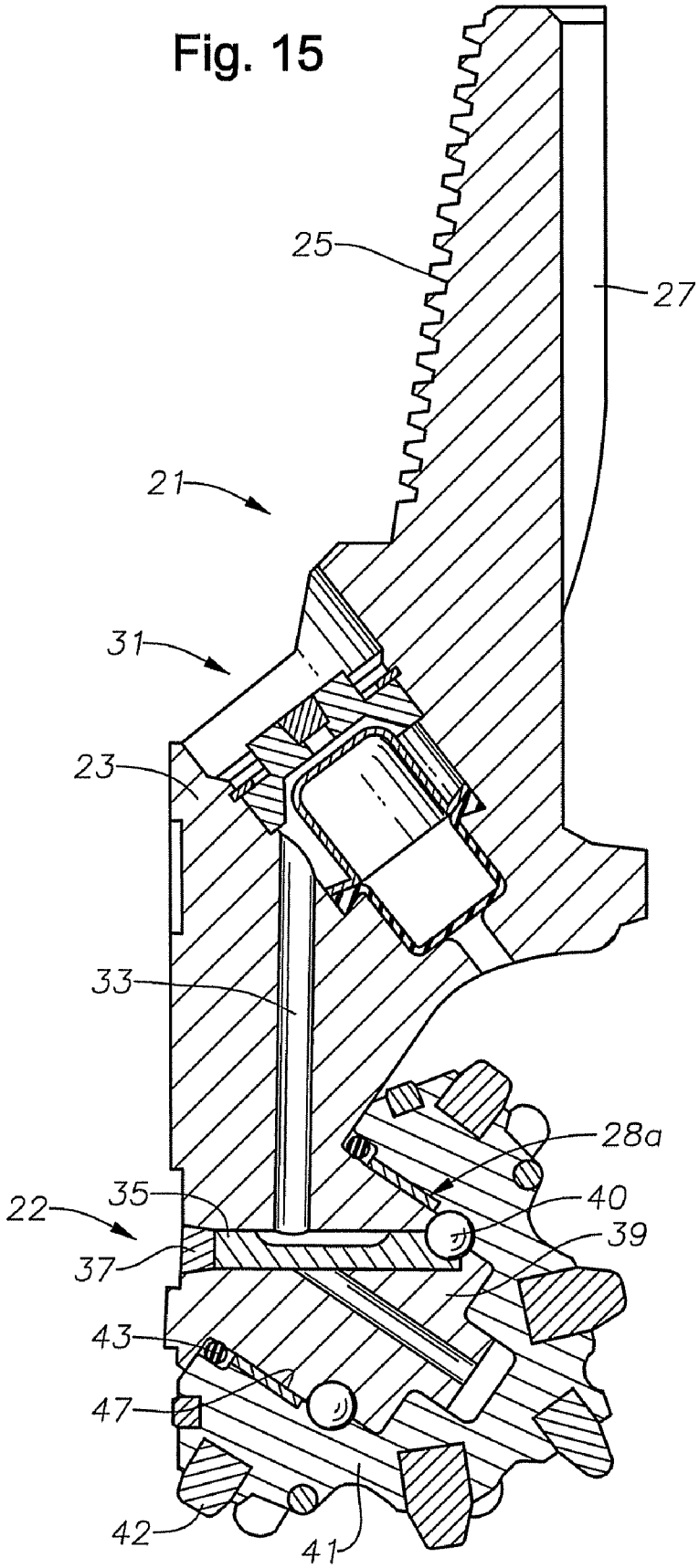
FIG. 15 is a sectional view of a bit body head section.

An optional embodiment of a journal bearing element 28 is provided in a side sectional view in FIG. 15. The journal bearing element 28*a* illustrated comprises a single circular member and mates over the journal section 26 (FIG. 9) outer diameter rather than in a recess. The journal bearing element 28*a* is installed on the bit 21 by slipping it over the free end of the bearing shaft 39 and sliding the journal bearing element 28*a* adjacent the journal bearing surface 47. The journal bearing element 28*a* can be coupled to the journal section 26 in any of the above described manners.

The material used in making the journal bearing element 28 of the present device may be any suitable material; examples of materials include steels, stainless steels, and hard metal alloys including various Stellite® alloys. A material formed using a powdered metal manufacturing technique may be used for the journal bearing element 28. For example, a high vanadium content stainless steel powder could be used in conjunction with a powdered metal manufacturing technique to form a suitable bearing element. One specific example of this is an alloy referred to herein as S90V®, the alloy has carbon with a content of about 2.3% by weight of the alloy, a chromium content of about 14% by weight of the alloy, a vanadium content of about 9% by weight of the alloy, and molybdenum content of about 1% by weight of the alloy. Additionally, AISI 440C chemistries could be used to form a suitable head bearing element. For the purposes of the present disclosure, high vanadium content includes a composition, such as metal or metal powders having about 3% by weight or more of vanadium. Alternative values for vanadium content include 4%, 5%, 6%, 7%, 8% by weight, and all values of weight percentages between.

In certain preferred embodiments, the bearing shaft element or sleeve substrate can be constructed from a D2 tool steel or AISI 440C stainless steel, which may then have the tungsten/tungsten carbide coating applied thereto.

Another set of powered metal alloys for use in making the journal bearing herein described includes a cobalt-chromium-tungsten-carbon alloy. Optionally, the alloy may have a carbon content of about 1.2% by weight or greater.

The powder compositions described herein may utilize "master melt" compositions wherein all particles have essentially the same chemistry. Using a solid state consolidation technique, such as sintered-hot-isostatic-pressing, maintains homogeneity of the final product thereby producing a solid material without voids.

Other bit components could be made from the compositions described herein. Those components include any load bearing surface within the roller cone bit including thrust surfaces; additionally, pilot pin elements could also be manufactured using the compositions cited herein.

EXAMPLES

The performance of tungsten/tungsten carbide coated bearing and seal components were evaluated in the laboratory. The performance of tungsten/tungsten carbide coating was also evaluated in thrust washer testing. A bearing test configured with a 5.08 cm diameter cantilever supported bearing shaft held stationary with respect to the rotating cone specimen was used to compare the load capacity and wear resistance of a standard bearing test shaft and a tungsten/tungsten carbide coated bearing test shaft. The specimens were lubricated with soap thickened grease. A 5.08 cm diameter standard bearing specimen was provided that included a cobalt alloy inlay bearing shaft and a hardened steel cone bearing with silver plating. A tungsten/tungsten carbide coating having a thickness of approximately 38.1 μm was applied to a hardened steel bearing ring and attached to a steel bearing shaft, and was run with a hardened steel cone bearing with silver plating. The load capacity test gradually increased load at constant rotation speed until a large increase in torque indicated bearing failure. The load capacity was measured to be 16% higher for the tungsten/tungsten carbide coated bearing specimen compared with the standard cobalt alloy specimen. The wear test was run at constant load and speed for approximately 100 hours. The cross sectional area of the resulting wear scar at the bottom dead center of the bearing shaft was 1.9E-7 square meters for the standard cobalt alloy specimen and 3.5E-9 square meters for the tungsten/tungsten carbide coated specimen.

As used herein, recitation of the term about and approximately with respect to a range of values should be interpreted to include both the upper and lower end of the recited range.

As used in the specification and claims, the singular form "a", "an" and "the" may include plural references, unless the context clearly dictates the singular form.

Although some embodiments of the present invention have been described in detail, it should be understood that various changes, substitutions, and alterations can be made hereupon without departing from the principle and scope of the invention.

The invention claimed is:

1. A drill bit for drilling a subterranean formation, comprising:

at least one leg;

a cantilevered bearing shaft comprising a base formed on the at least one leg and having a substantially cylindrical surface extending from the base defining a longitudinal axis;

a roller cone disposed about the bearing shaft and configured to rotate about the longitudinal axis, said roller cone comprising an exterior surface for contacting the subterranean formation and an interior surface disposed about the bearing shaft; and a sealing element;

an indentation adapted to receive a bearing shaft element, said indentation being formed circumferentially within the bearing shaft;

a bearing shaft element secured in the circumferential indentation in the bearing shaft, thereby forming a portion of the exterior surface of the bearing shaft;

wherein at least a portion of an exterior surface of the bearing shaft includes a tungsten/tungsten carbide coating, said tungsten/tungsten carbide coating comprising tungsten carbide nano-particles dispersed in a tungsten matrix.

2. The drill bit of claim 1 wherein the sealing element comprises a tungsten/tungsten carbide coating on a metallic sliding surface thereof.

3. The drill bit of claim 1 further comprising at least one seal element disposed circumferentially about the base of the bearing shaft, wherein said bearing shaft includes a tungsten/tungsten carbide coating applied to the location where the seal element contacts the bearing shaft.

4. The drill bit of claim 1 wherein said bearing shaft further comprises a locking ball race including a plurality of locking balls disposed therein, wherein at least one of the locking ball race and the plurality of locking balls comprise a tungsten/tungsten carbide coating applied thereto.

5. The drill bit of claim 1 wherein said bearing shaft further comprises a bearing race including a plurality of rollers disposed therein, wherein at least one of the bearing race and the plurality of rollers comprise a tungsten/tungsten carbide coating applied thereto.

6. The drill bit of claim 1 wherein the bearing shaft includes at least one thrust face contacting an interior portion of the cone, wherein at least one of the at least one thrust face and the interior portion of the cone contacting the thrust face further comprises a tungsten/tungsten carbide coating applied thereto.

7. A drill bit for drilling subterranean formations comprising:

at least one leg;

a cantilevered bearing shaft comprising a base formed at the at least one leg and having a substantially cylindrical surface extending from the base defining a longitudinal axis, said bearing shaft having a lateral side surface and at least one thrust face located at a distal end thereof, said lateral side surface having a circumferential indentation formed substantially aligned with the longitudinal axis;

a bearing shaft element secured in the bearing shaft indentation;

a roller cone disposed about the bearing shaft and configured to rotate about the longitudinal axis, said roller cone comprising an exterior surface comprising a plurality of cutting elements for contacting the subterranean formation and an interior surface disposed about the bearing shaft;

an annular shaft seal groove formed at the base of the bearing shaft; and a shaft seal ring disposed within the annular shaft seal groove;

wherein at least a portion of an exterior surface of the bearing shaft element includes a wear resistant surface treatment applied thereto, said wear resistant surface coating comprises a vapor deposited tungsten compound.

8. The drill bit of claim 7 wherein the wear resistant surface coating is applied to an exterior surface of the bearing shaft element by chemical vapor deposition.

9. The drill bit of claim 7 wherein the bearing shaft element is secured to the bearing shaft by means of brazing, gluing, soldering or welding.

10. The drill bit of claim 7 wherein the wear resistant coating has a thickness of between about 5 and 300 μm.

11. The drill bit of claim 7 further comprising:

a bearing race disposed circumferentially about a distal end of the bearing shaft; and a plurality of locking balls disposed within the bearing race, said locking balls having a surface and being operable to secure the cone on the bearing shaft;

wherein at least one of the bearing race or the plurality of locking balls comprise a wear resistant coating applied to the surface thereof.

12. The drill bit of claim 7 further comprising:

a plurality of rollers positioned about the lateral surface of the bearing shaft, wherein an outer surface of the plurality of rollers comprises a wear resistant coating applied to the surface thereof.

13. A earth boring bit, comprising:

a bit body;

at least one leg;

a cantilevered bearing shaft comprising a base formed on the at least one leg and having a substantially cylindrical surface extending from the base defining a longitudinal axis;

a roller cone disposed about the bearing shaft and configured to rotate about the longitudinal axis, said roller cone comprising an exterior surface for contacting the subterranean formation and an interior surface disposed about the bearing shaft; and a bearing shaft element formed separately from the drill bit secured to the bearing shaft;

wherein at least a portion of an exterior surface of the bearing shaft element includes a tungsten/tungsten carbide coating, said tungsten/tungsten carbide coating comprising tungsten carbide nano-particles dispersed in a tungsten matrix and wherein the tungsten/tungsten carbide coating is a multilayer coating comprising alternating layers of tungsten and tungsten carbide.

14. The drill bit of claim 13 further comprising securing the bearing shaft element secured to the bearing shaft, wherein said tungsten/tungsten carbide coating is applied to an exterior surface of said bearing shaft element.

15. The earth boring bit of claim 14 wherein the bearing shaft element is secured to the bearing shaft by a process selected from the group consisting of brazing, soldering, gluing and welding.

16. The earth boring bit of claim 13 wherein the bearing shaft further comprises a circumferential indentation adapted to receive the bearing shaft element, said bearing shaft element being positioned within the indentation.

17. The earth boring bit of claim 13 wherein adhering the bearing shaft element to the bearing shaft prevents circumferential sliding of the bearing shaft element around the bearing shaft.

18. The earth boring bit of claim 13 wherein the wear resistant coating comprises a first layer comprising tungsten and a second layer comprising tungsten carbide.

19. The method of claim 13 wherein the bearing shaft comprises at least one thrust surface, wherein the tungsten/tungsten carbide coating is applied to the at least one thrust surface.

20. The drill bit of claim 13 wherein said bearing shaft further comprises a bearing race including a plurality of rollers disposed therein, wherein at least one of the bearing race and the plurality of rollers comprise a tungsten/tungsten carbide coating applied thereto.

21. The drill bit of claim 13 further comprising:

a plurality of rollers positioned about the lateral surface of the bearing shaft, wherein an outer surface of the plurality of rollers comprises a wear resistant coating applied to the surface thereof.

* * * * *